United States Patent [19]

Bing

[11] Patent Number: 4,838,179

[45] Date of Patent: Jun. 13, 1989

[54] PORTABLE COLLAPSIBLE GAME TABLE

[76] Inventor: Ting S. Bing, 12 Jalan 13-4, 46200 Petaling, Jaya, Malaysia

[21] Appl. No.: 170,805

[22] Filed: Mar. 21, 1988

[51] Int. Cl.[4] ..... A47B 3/00

[52] U.S. Cl. ..... 108/132; 108/116; 108/90

[58] Field of Search ..... 108/132, 131, 116, 13, 108/90

[56] References Cited

U.S. PATENT DOCUMENTS

| | | | |
|---|---|---|---|
| D. 161,407 | 1/1951 | Anderson et al. | D34/3 |
| 161,502 | 3/1875 | Gilbert | 108/90 |
| 1,850,420 | 3/1932 | Schuldt | 108/13 |
| 2,008,613 | 7/1935 | Hernes | 108/90 |
| 2,799,546 | 7/1957 | Lowry | 108/116 |
| 2,817,567 | 12/1957 | Shepherdson | 108/132 |
| 2,818,256 | 12/1957 | Hopper | 108/116 |

FOREIGN PATENT DOCUMENTS

| | | | |
|---|---|---|---|
| 1547642 | 10/1968 | France | 108/90 |
| 621258 | 4/1949 | United Kingdom | 108/90 |

*Primary Examiner*—Peter A. Aschenbrenner
*Attorney, Agent, or Firm*—Kenway & Crowley

[57] ABSTRACT

A collapsible portable game table in which all accessories and equipment are retainable in a small volume defined by parallel planes and the top and bottom of a rectangular frame disposed between said parallel planes. Cue sticks used in playing a billiard game serve to lock the table supports in position for storage and further serve as convenient handles for carrying the table when collapsed. An auxiliary board having a reversible subframe fitting within the frame of the basic table permits the playing of additional games.

7 Claims, 4 Drawing Sheets

PORTABLE COLLAPSIBLE GAME TABLE

This invention relates in general to a game table, and in particular to one which is convertible, collapsible, and portable.

Tables for the playing of games have been in existence for untold years. They have ranged from simple folding tables for card games to massive immovable pool and billiard tables or large folding tables for games such as table tennis. Because of space requirements both for use and storage of such tables, miniature units for pool, billiards, and table tennis have been developed. Frequently, removable tops are provided to permit the playing of games requiring a smooth flat surface rather than a surface surrounded by walls or rails as needed in billiards. Also, to minimize storage space required for game tables when they are not in use, it is common to utilize collapsible supports for the playing surface.

Almost all games require accessory equipment as well as implements for use by the players. For example, with a table which is to be used for pool or billiards, pool balls and a rack are needed. So also are pool cues of appropriate size and design for the players. Obviously, it would be helpful if these accessories and implements could be stored along with the basic table. A storage system in which all of the equipment and implements could be conveniently grouped together in a small volume would be desirable to prevent loss of parts or playing equipment as well as easy access and a quick set-up for game playing.

It is therefore a primary object of the present invention to make available a full complement of parts and equipment for game playing in an integrated volume.

It is another object of the invention to incorporate storage and handling functions in a compact game assembly.

Another object of the present invention is a versatile table with interchangeable tops permitting the playing of various games.

Still another object is a simplified carrying arrangement which utilizes stored equipment.

A further object is to make available in a portable game table a leveling system for the game playing surface.

SUMMARY OF THE INVENTION

Generally, the invention consists of a basic flat playing surface which is depressed beneath the level of surrounding walls. Mounted on the inwardly facing surface of the walls are resilient cushions which serve as rails for pool balls to ricochet about the table. Openings are provided at the corners of the playing surface and midway along the two long rails of the table for pockets as is conventional for pool or pocket billiard playing.

The table is supported at a convenient height by sturdy hinged legs from which braces pivot and extend to the playing surface. The braces may be locked to hold the legs in position when the table is erected. They are also adjustable in their point of contact with the playing surface to permit leveling of that surface. Depending from the table is a flexible zippered pouch for containing pool balls, and that pouch may be closed and disposed in a compartment under the table for storage. A reversible top which has a sub-frame to be fitted within the raised upper walls of the pool table has a table tennis surface on one side and game boards for checkers, chess, backgammon and the like on the other side.

Pool cues and a triangular ball rack are provided, and the supporting structure beneath the table is appropriately slotted and bored to accommodate the rack and cues. The cues when stored serve as carrying handles for the entire table and accessory assembly and also lock the legs and braces against the bottom of the table within the volume defined by the playing surface and the plane of the bottom surfaces of the walls.

For a better understanding of the present invention, together with other and further objects, features, and advantages, reference should be had to the following description of a preferred embodiment which should be read with reference to the appended drawing in which:

DESCRIPTION OF PREFERRED EMBODIMENT

Figure 1:
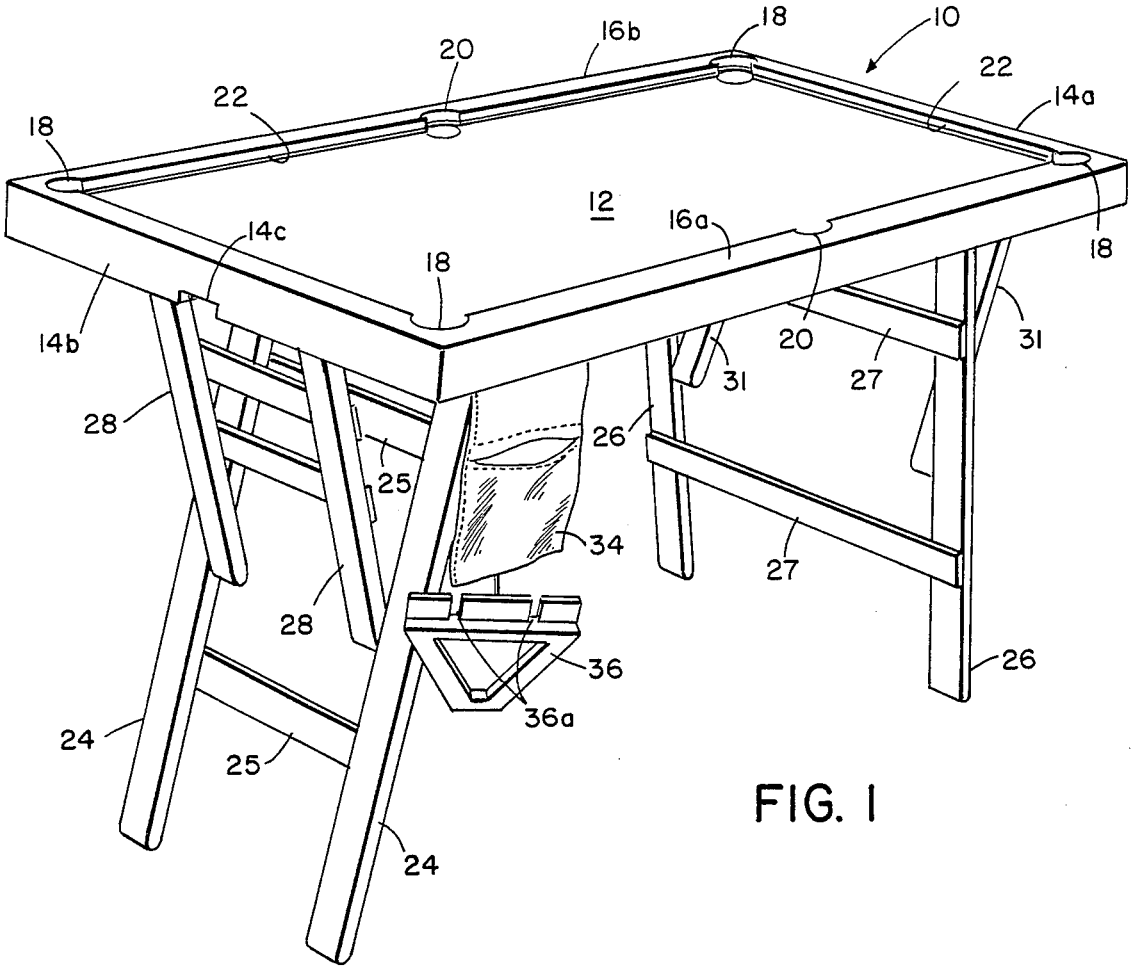
FIG. 1 is a view in perspective of the table erected for playing pocket billards.

In FIG. 1 there may be seen a table 10 for the playing of games. The table includes a flat playing surface 12 which may have reinforcing members beneath it and which is retained in a rectangular frame composed of two relatively short members **14*a* and 14*b* and two relatively long members 16*a* and 16*b*. The playing surface 12 lies in a plane parallel to and depressed from the plane which includes the tops of the frame members. In this fashion, the upper portions of the frame members constitute walls or rails surrounding the playing surface 12**.

Openings are formed at the corners of the frame and in the contiguous portion of the playing surface to serve as corner pockets 18 for the playing of pool or pocket billiards. Side pockets 20 are similarly formed midway along the length of the rails **16*a* and 16*b*. Resilient cushions 22 are disposed in the inwardly facing surfaces of the rails which make up the frame. They are at a height convenient to permit pool balls of a preselected diameter to ricochet about the playing surface 12**.

The playing surface of the table is at a convenient height determined by sets of collapsible legs 24 and 26. The legs 24 are strengthened by cross-ties 25 and the legs 26 are similarly strengthened by cross-ties 27. An adjustable locking brace 28 is pivotally attached to the facing surfaces of the support legs 24. A comparable adjustable locking brace 31 is pivotally mounted on the legs 26. Depending from the frame member **16*a* is a closable pouch 34 which may be used to hold and store billiard balls. A triangular rack 36 having a slotted extension 36*a* is also suspended from the frame member 16*a*** by any convenient means.

Figure 2:
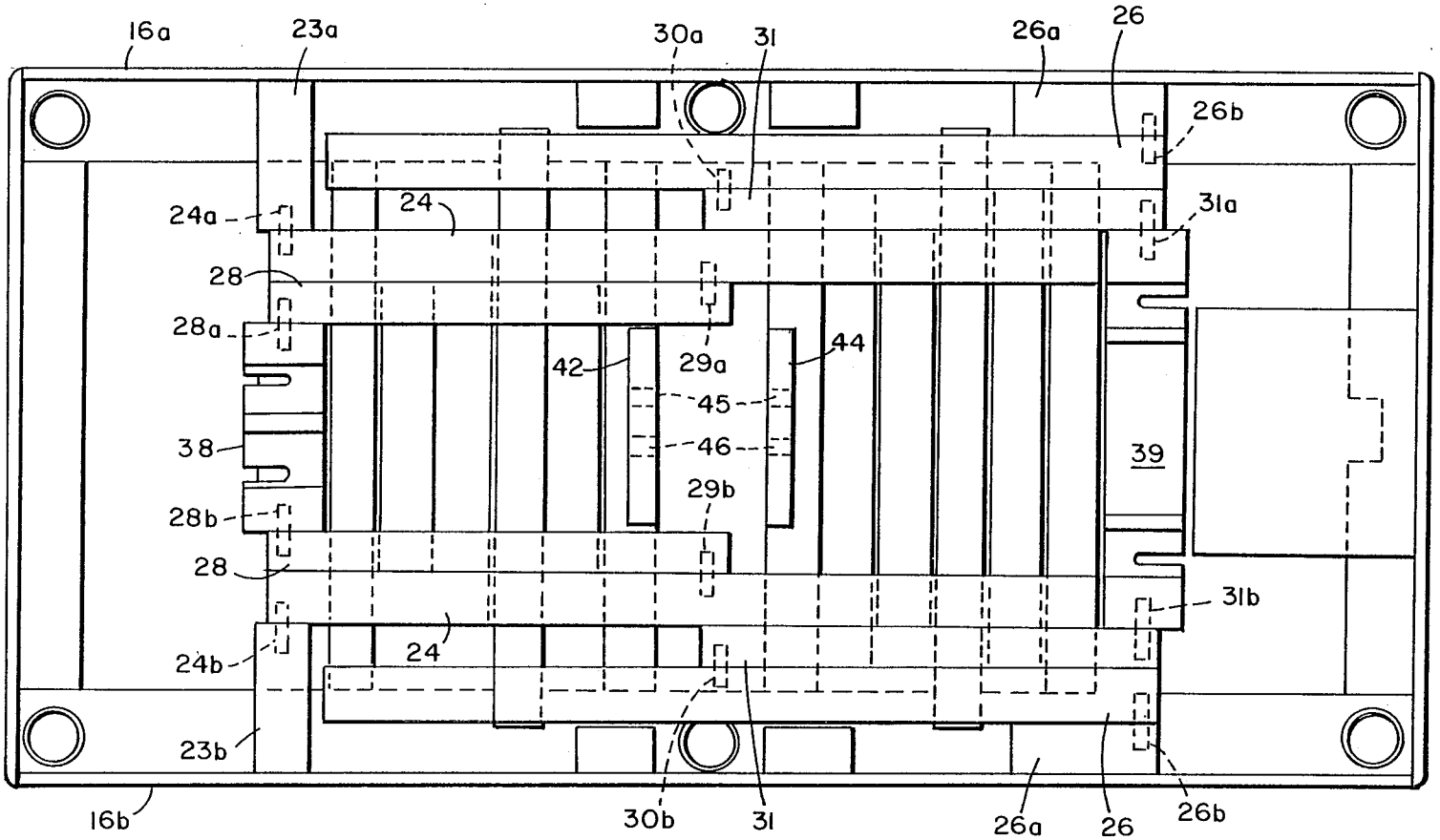
FIG. 2 is a bottom view of the table in collapsed condition.

In FIG. 2, the underside of the table is shown with the table support system collapsed against the bottom of the playing surface. The relatively narrowly spaced legs 24 may be seen to be hinged from blocks **23*a* and 23*b* by means of pins 24*a* and 24*b*. The blocks 24*a* are firmly attached to the table adjacent the frame members 16*a* and 16*b* respectively. Adjacent the opposite end of the table, the relatively widely spaced legs 26 may be seen to be similarly pivoted from attached blocks 26a by means of hinge pins 26b**.

The locking brace 28 is pivotally connected by pins 29a and 29b to the inwardly facing sides of the narrowly spaced legs 24 adjacent the center of the table. At the left end of the braces 28 as shown in the drawing, the two brace members are joined by a slotted adjustment member 38. The member 38 is made pivotal with respect to the braces 28 by means of hinge pins 28a and 28b.

The relatively widely spaced legs 26 are joined to their associated locking braces 31 as seen near the center of the drawing by pivot pins 30 a and 30b. The locking braces 31 are joined together by means of slotted adjustment member 39 which is made pivotal with respect to the locking braces by means of the pivot pins 31a and 31b. Also visible in this view is a pair of holding blocks 42 and 44. Aligned openings 45 and 46 parallel to the rails 16a and 16b are bored through the blocks 42 and 44 to serve as receptacles for pool cues as will be explained in greater detail hereinbelow.

Figure 3:
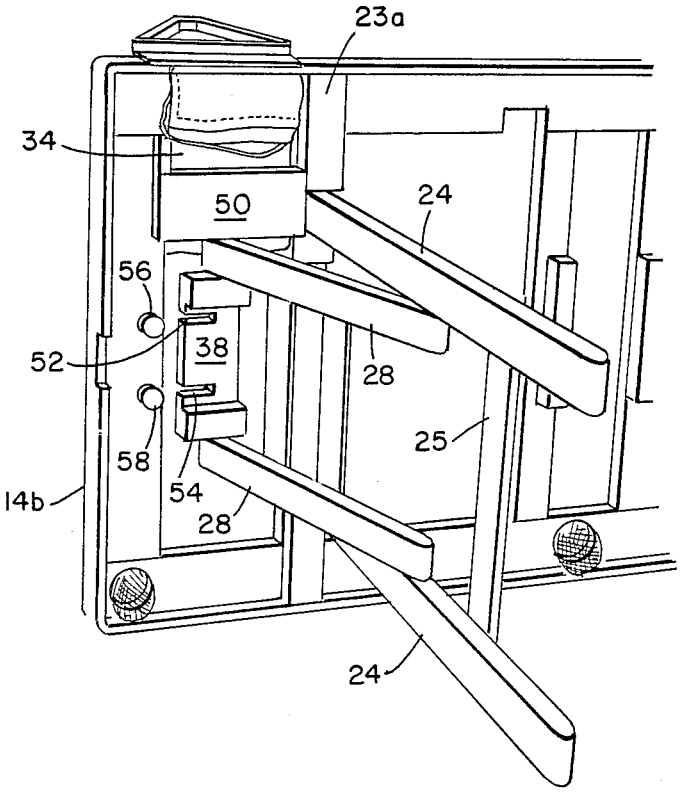
FIG. 3 is a partial bottom view showing detail of the levelling and support mechanisms for the table.
Figure 6:
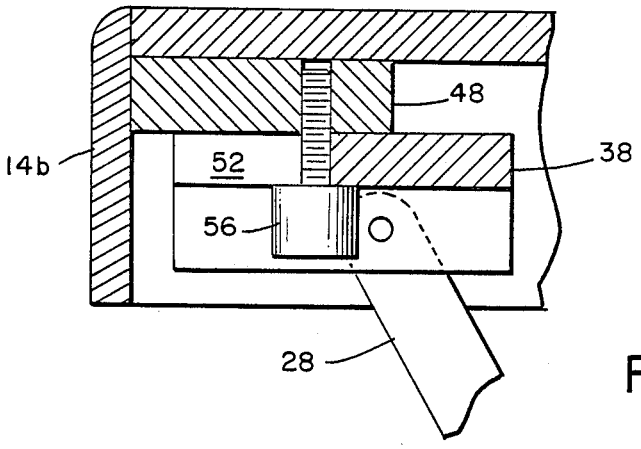
FIG. 6 illustrates the height adjustment system.

In FIG. 3, one end of the underside of the table is shown. The frame member 14b is visible at the left of the drawing, and it abuts a support member 48 which underlies the playing surface of the table. A compartment for the pouch 34 is formed under the playing surface, between the support 48 and the block 23a by means of a wall 50. As shown in FIG. 6, the adjustment member 38 has parallel slots 52 and 54 arranged to be engaged by knobs 56 and 58 respectively. The knobs 56 and 58 have threaded shanks which screw into the support 48 and may be tightened down upon the adjustment member 38 at any desired location in the slots in which the shanks fit. The position at which the adjustment member 38 is locked by means of the knobs 56 and 58 determines the angle assumed by the legs 24 relative to the playing surface of the table. Thus, the playing surface may be levelled and the knobs 56 and 58 tightened to immobilize the legs 24 by means of the locking brace 28. The same general arrangements are provided at the opposite end of the table or the adjustment member 39, and that end of the table may be similarly levelled for play.

Figure 4:
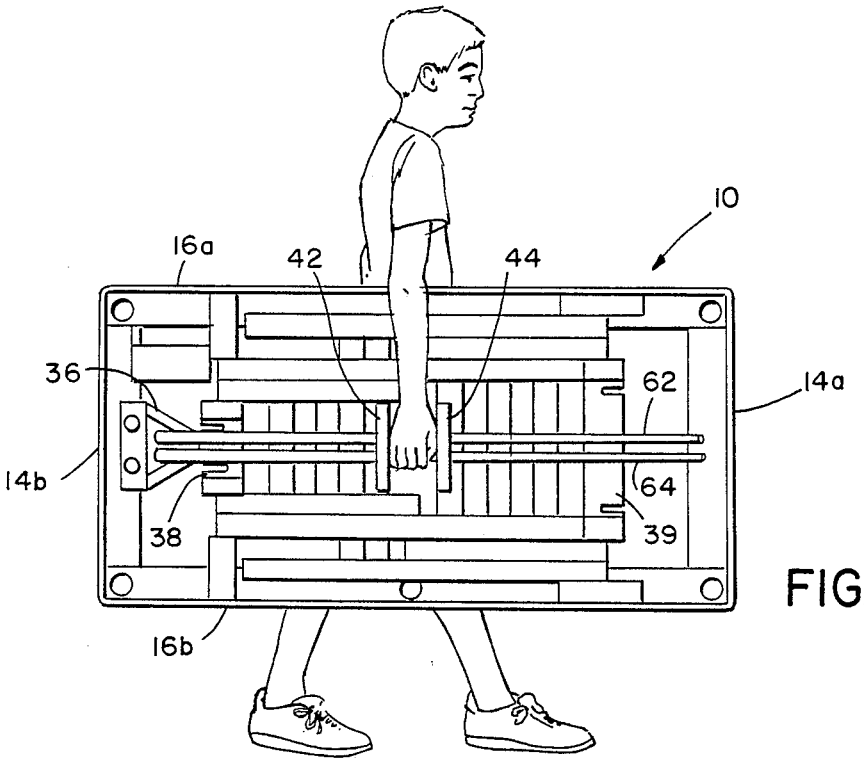
FIG. 4 shows a table being carried.

FIG. 4 shows the table collapsed and being carried. It will be noted that all support and accessory elements are either flat against or held close to the bottom surface of the table and well within the volume defined by the bottom of the playing surface and the plane parallel to that surface which includes the bottoms of the frame members 14a, 14b, 16a, and 16b. Pool cues 62 and 64 which may be inserted through the slot 14c in the rail 14b pass through the aligned openings 45 and 46 in the blocks 42 and 44 and bear upon cross-ties to lock the legs and braces in collapsed positions. It will be noted that when the table is fully collapsed as shown in FIG. 4, the adjustment members 38 and 39 are well retracted from their holding knobs such as the knobs 56 and 58.

The holding knobs 56 and 58 perform another and different function when the table is to be stored, however. It will be noted that the triangular pool rack 36 has parallel slots 36a cut in an extension of one of the triangular sides. These slots 36a are properly spaced to accommodate the shanks and knobs 56 and 58. With the knobs bearing on the rack extension, the rack 36 is conveniently retained in storage. Similarly, the pouch 34 is maintained in the compartment beneath the wall 50.

Figure 5:
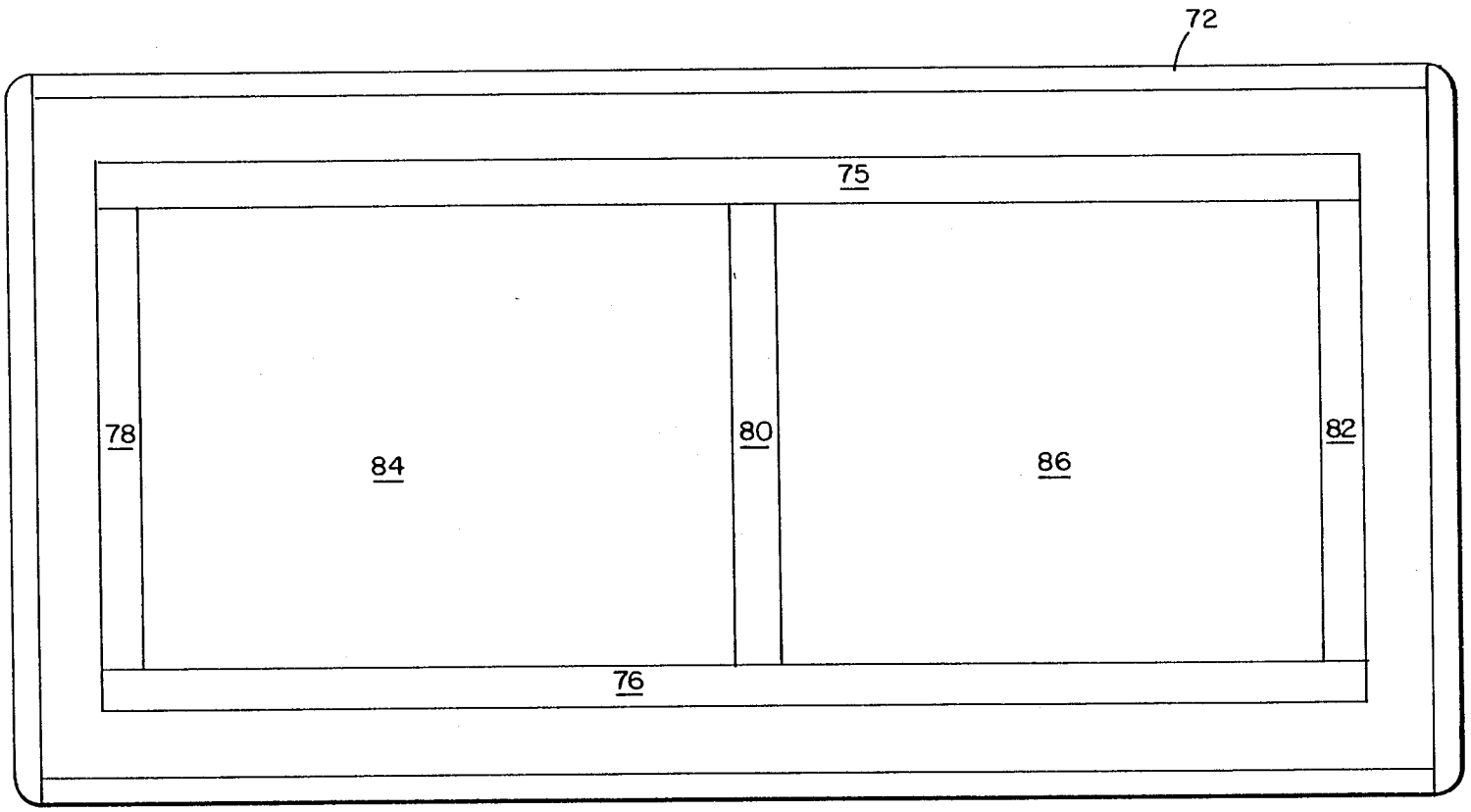
FIG. 5 illustrates an auxiliary playing surface.

In FIG. 5, a reversible auxiliary game board is shown. The auxiliary game board includes one surface which is completely smooth and flat and useful as a desk or for table tennis playing. In the latter case, suitable slots may be formed midway in the frame members 16a and 16b to accommodate posts between which a table tennis net may be stretched across the flat playing surface. In FIG. 5, however, it is the opposite surface of the auxiliary game board which is shown. It includes first a thin, flat board 72 dimensioned to fit on the top of the frame members of the pool table substantially without overlap. Mounted on the opposite surface of the board 72 is a frame 74 made up of two relatively long members 75 and 76 and three relatively short members 78, 80 and 82. The frame 74 is of the proper outside dimensions to fit snugly within the cushions mounted on the inside walls of the frame members 14a, 14b, 16a, and 16b. The areas 84 and 86 formed within the subframe members may be suitably marked for the playing of chess, checkers, backgammon, etc.

What is claimed is:

1. A collapsible and portable table for playing games comprising four walls joined to form a rectangular frame of predetermined height, a playing surface mounted in said frame in a plane beneath that of the top of said frame, resilient cushions disposed upon the inwardly facing interior surfaces of said walls above said playing surface, a plurality of recesses and pockets formed at predetermined points about said playing surface, support means including legs, hinges and braces for normally supporting said frame and said playing surface at a height convenient to players utilizing said table, said hinges connecting said legs beneath said playing surface and said braces having first ends pivotably connected to said legs and second ends bearing upon and adjustably retainable at points beneath said playing surface whereby said playing surface may be adjusted, said support means being sized and configured to be collapsed for storage within a given volume defined by the bottom of said playing surface, the portions of the walls of said frame disposed beneath said playing surface and a plane which includes the bottom of said frame, and means including cue sticks for locking said support means collapsed for storage within said given volume.

2. A collapsible and portable table for playing games as defined in claim 1, further including blocks fixed beneath said playing surface, said blocks having openings formed therein at aligned points, insertion of said cue sticks in said openings after collapse of said support means, immobilizing said support means in a locked position, and forming a handle convenient for carrying said table.

3. A collapsible and portable table for playing games as defined in claim 2 and further including a compartment formed beneath said playing surface, and a closable pouch for holding game balls disposed in said compartment, said compartment lying entirely within said given volume.

4. A collapsible and portable table for playing games as defined in claim 1 and further including an auxiliary game playing board having a first unobstructed surface of an area substantially equal to that defined by said rectangular frame and a second opposite surface having a second frame mounted thereon, said second frame having an area substantially the same as that defined by said resilient cushions, whereby said auxiliary game board may be mounted on said table and held in fixed position relative thereto.

5. A collapsible and portable table for playing games as defined in claim 2 wherein said braces comprise parallel members, an adjustment member and pivot pins connecting the ends of said parallel members to said adjustment member, said adjustment member having slots formed therein, and knobs threadably connected to the underside of said table having shanks passing through said slots and surfaces for bearing against said adjustment members to adjustably fix the position of said adjustment members relative to said underside of said table when said table is erected.

6. A collapsible and portable table for playing games as defined in claim 5 wherein the position of said adjustment member relative to said table determines the angles of said braces and said legs relative to said table and thereby the level of said table.

7. A collapsible and portable table for playing games as defined in claim 5 and further including a triangular rack for game balls, an extension being formed on said rack and also having slots formed therein, said surfaces of said knobs being adapted to bear against said extension to hold said rack against said underside of said table when said table is collapsed.

* * * * *